US010982619B2

(12) United States Patent
Ohori et al.

(10) Patent No.: US 10,982,619 B2
(45) Date of Patent: Apr. 20, 2021

(54) CONTROLLER AND CONTROL METHOD FOR VEHICLE, AND MEMORY MEDIUM

(71) Applicant: TOYOTA JIDOSHA KABUSHIKI KAISHA, Toyota (JP)

(72) Inventors: Shinya Ohori, Miyoshi (JP); Naoya Okubo, Chiryu (JP); Yukio Kobayashi, Kasugai (JP); Seiji Hino, Nissin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/856,197

(22) Filed: Apr. 23, 2020

(65) Prior Publication Data

US 2020/0408164 A1 Dec. 31, 2020

(30) Foreign Application Priority Data

Jun. 28, 2019 (JP) ..... JP2019-120810

(51) Int. Cl.

| | |
|---|---|
| ***F02D 41/38*** | (2006.01) |
| ***F02M 61/14*** | (2006.01) |
| ***F02M 59/00*** | (2006.01) |
| ***F02D 41/06*** | (2006.01) |
| ***F02M 55/02*** | (2006.01) |

(52) U.S. Cl.

CPC ..... *F02D 41/38* (2013.01); *F02D 41/068* (2013.01); *F02M 55/025* (2013.01); *F02M 59/00* (2013.01); *F02M 61/14* (2013.01); *F02D 2200/0602* (2013.01); *F02D 2200/70* (2013.01)

(58) Field of Classification Search

CPC ..... F02D 41/38; F02D 41/068; F02M 55/025; F02M 59/00; F02M 61/14

USPC ..... 123/457

See application file for complete search history.

(56) References Cited

U.S. PATENT DOCUMENTS

2015/0184610 A1* 7/2015 Onozawa ..... F02D 41/3836 123/294

2018/0163661 A1 6/2018 Ohori et al.

FOREIGN PATENT DOCUMENTS

DE 10254464 A1 * 7/2003 ..... F02D 41/3836

JP 2018-96278 A 6/2018

* cited by examiner

*Primary Examiner* — Mahmoud Gimie

(74) *Attorney, Agent, or Firm* — Oblon, McClelland, Maier & Neustadt, L.L.P.

(57) ABSTRACT

A controller for vehicle is provided. A determining section obtains fuel pressure in a delivery pipe and performs a rationality check for determining whether the obtained fuel pressure is within a normal range. The determining section shifts the normal range toward a high pressure side when a second index value of a vehicle outside temperature is higher than a first index value as compared with when the second index value is not higher than the first index value. The second index value is obtained when the determining section is activated. The first index value is stored in a nonvolatile memory before a main switch is turned off so that power supply is stopped.

7 Claims, 7 Drawing Sheets

CONTROLLER AND CONTROL METHOD FOR VEHICLE, AND MEMORY MEDIUM

BACKGROUND

1. Field

The following description relates to a controller and a control method for controlling a vehicle equipped with an internal combustion engine.

2. Description of Related Art

Japanese Laid-Open Patent Publication No. 2018-96278 discloses atypical controller that perform is a rationality check of a fuel pressure sensor provided in a high-pressure fuel supply system of an internal combustion engine mounted on a vehicle. When the amount of time elapsed since a main switch of the vehicle was turned off reaches a specified amount of time, the controller detects a fuel pressure using the fuel pressure sensor provided in a delivery pipe of the high-pressure fuel supply system. The controller then determines whether the detected pressure is within a normal range.

When the main switch of the vehicle is off and the internal combustion engine is in a stopped state, the delivery pipe is sealed. Thus, due to a reduction in a volume of the fuel that accompanies a decrease in a fuel temperature from the point in time when the main switch was turned off, the fuel pressure in the delivery pipe is also decreased. The length of the specified amount of time is determined such that the elapse of the specified amount of time allows the following to be assumed. Specifically, the specified amount of time is set to allow for, based on the elapse of the specified amount of time, the assumption that the decrease in the fuel pressure from the point in time when the main switch was turned off is sufficient to cause the fuel pressure in the delivery pipe to decrease to a value in the vicinity of a reference pressure, which is the median of the normal range.

If the vehicle outside temperature increases after the main switch was turned off, the temperature of fuel when the specified amount of time has elapsed may be high. That is, the fuel pressure in the delivery pipe may become higher than the reference pressure. In such a case, even if the fuel pressure sensor is operating normally, the fuel pressure that is detected when the specified amount of time has elapsed may be out of the normal range. That is, an erroneous determination of a state of the fuel pressure may be made.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Examples of the present disclosure will now be described.

Example 1. A controller for a vehicle is employed in a vehicle equipped with an internal combustion engine. The vehicle includes a high-pressure fuel pump, a delivery pipe that stores high-pressure fuel pressurized by the high-pressure fuel pump, a fuel injection valve that injects fuel stored in the delivery pipe, and a fuel pressure sensor that detects pressure of the fuel in the delivery pipe. The controller includes a soak timer that measures an amount of time elapsed since a main switch of the vehicle was turned off, a nonvolatile memory that retains information even when the main switch is turned off so that power supply is stopped, a determining section that is activated when the elapsed amount of time reaches a specified amount of time while the main switch is off. The determining section is configured to obtain fuel pressure using the fuel pressure sensor when activated, perform a rationality check for determining whether the obtained fuel pressure is within a normal range, store a first index value of a vehicle outside temperature in the nonvolatile memory, and shift the normal range, which is used in the rationality check, toward a high pressure side when a second index value is higher than the first index value as compared with when the second index value is not higher than the first index value. The first index value is stored in the nonvolatile memory before the main switch is turned off so that the power supply is stopped. The second index value is an index value of the vehicle outside temperature obtained when the elapsed amount of time reaches the specified amount of time so that the determining section is activated.

With the above-described configuration, when the second index value of the vehicle outside temperature obtained when the determining section is activated while the main switch is off is higher than the first index value of the vehicle outside temperature, which is stored in the nonvolatile memory, that is, when it is assumed that the vehicle outside temperature is higher than the vehicle outside temperature when the main switch was turned off, the normal range used in the rationality check is shifted toward the high pressure side. The fuel pressure is thus likely to remain in the normal range. That is, the above-described configuration shifts the normal range toward the high pressure side in correspondence with a change in the vehicle outside temperature. This prevents an erroneous determination from being made due to an increase in the vehicle outside temperature, for example, despite the normal operation of the fuel pressure sensor.

Example 2. In the controller for a vehicle of Example 1, the determining section is configured to increase a shift amount by which the normal range is shifted toward the high pressure side as a difference between the second index value and the first index value increases when the second index value is higher than the first index value. The first index value is stored in the nonvolatile memory before the main switch is turned off so that operation of the determining section is stopped.

The above-described configuration is capable of changing the normal range by an amount corresponding to the deviation between the first index value of the vehicle outside temperature, which is stored in the nonvolatile memory, and the second index value of the vehicle outside temperature obtained by activating the determining section while the main switch is off. This configuration thus allows the normal range to be more finely changed than a configuration in which whether to change the normal range is determined based on the second index value of the vehicle outside temperature obtained by activating the determining section while the main switch is off is deviated from the first index value of the vehicle outside temperature, which is stored in the nonvolatile memory, by a certain amount. This configuration thus allows the normal range to be more finely changed than a configuration in which the normal range is changed by a uniform amount when there is a deviation between the first index value and the second index value.

Example 3. In the controller for a vehicle of Example 1 or Example 2, the determining section is configured to obtain a coolant temperature of the internal combustion engine by being activated when the elapsed amount of time reaches the specified amount of time. The determining section is configured to perform the rationality check if a performance condition is met, the performance condition being a logical conjunction of (i) a warm-up index value being greater than or equal to a threshold, and (ii) the obtained coolant temperature being lower than a specified temperature. The warm-up index value is stored in the nonvolatile memory when the main switch is turned off so that operation of the determining section is stopped. The warm-up index value increases as an extent of warm-up of the internal combustion engine becomes higher. The specified temperature is lower than a warm-up completion temperature.

The rationality check is performed when the elapsed amount of time measured by the soak timer reaches the specified amount of time. The rationality check should be performed on the assumption that the fuel pressure has decreased to the vicinity of the reference pressure, which is the median of the normal range. Therefore, in order to perform the rationality check, the fuel temperature needs to decrease a certain extent from a state of being relatively high. That is, in order to properly perform the rationality check, the reduction in the volume of the fuel stored in the delivery pipe due to the decrease in the temperature of the stored fuel needs to have progressed sufficiently to cause the fuel pressure to decrease to the vicinity of the reference pressure.

In the above-described configuration, the performance condition for the rationality check is the logical conjunction of (i) the warm-up index value being greater than or equal to the threshold and (ii) the coolant temperature obtained when the elapsed amount of time reaches the specified amount of time being lower than the specified temperature. The warm-up index value is correlated with the fuel temperature when the main switch is turned off. The coolant temperature obtained when the elapsed amount of time reaches the specified amount of time is correlated with the fuel temperature when the elapsed amount of time reaches the specified amount of time. That is, in the above-described configuration, the rationality check is performed on a condition that it is assumed that the fuel pressure has decreased a certain extent from a state of being relatively high, in addition to the condition that the elapsed amount of time has reached the specified amount of time. This allows the rationality check to be performed after confirming the progress of the reduction in the volume of the fuel stored in the delivery pipe due to the decrease in the temperature of the stored fuel. That is, the rationality check is performed after accurately confirming that the condition suitable for the performance of the rationality check is met.

Example 4. In the controller for a vehicle of Example 3, the specified amount of time is one of specified amounts of time having different lengths. The determining section is configured to be activated by the soak timer each time the elapsed amount of time reaches each of the specified amounts of time and to determine whether the performance condition is met when activated. The determining section is configured to perform the rationality check if the performance condition is met. The controller is configured not to perform the rationality check and to stop the operation of the determining section if the performance condition is not met.

Since the above-described configuration allows the rationality check to be performed when the condition suitable for the performance of the rationality check is met, the accuracy of the rationality check is ensured. This ensures opportunities for performance of the rationality check.

Example 5. In accordance with one aspect of the controller for a vehicle of Example 4, the controller is configured not to activate the determining section while a state in which the main switch is off is continuing after the rationality check is completed once while a state in which the main switch is off is continuing, so that the rationality check is not performed.

With the above-described configuration, the rationality check is performed only once during the period in which the main switch is off. This allows the result of the rationality check to be quickly concluded as compared with a case in which the rationality check is performed each time the elapsed amount of time reaches each of multiple specified amounts of time, for example, after the rationality check is completed.

Example 6: A method for controlling a vehicle is provided that performs the various processes described in any one of the above-described Examples.

Example 7: A non-transitory computer readable memory medium is provided that stores a program that causes a processor to perform the various processes described in any one of the above-described Examples.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A controller 400 for a vehicle 10 according to an embodiment of the present disclosure will now be described with reference to FIGS. 1 to 6.

Figure 1:
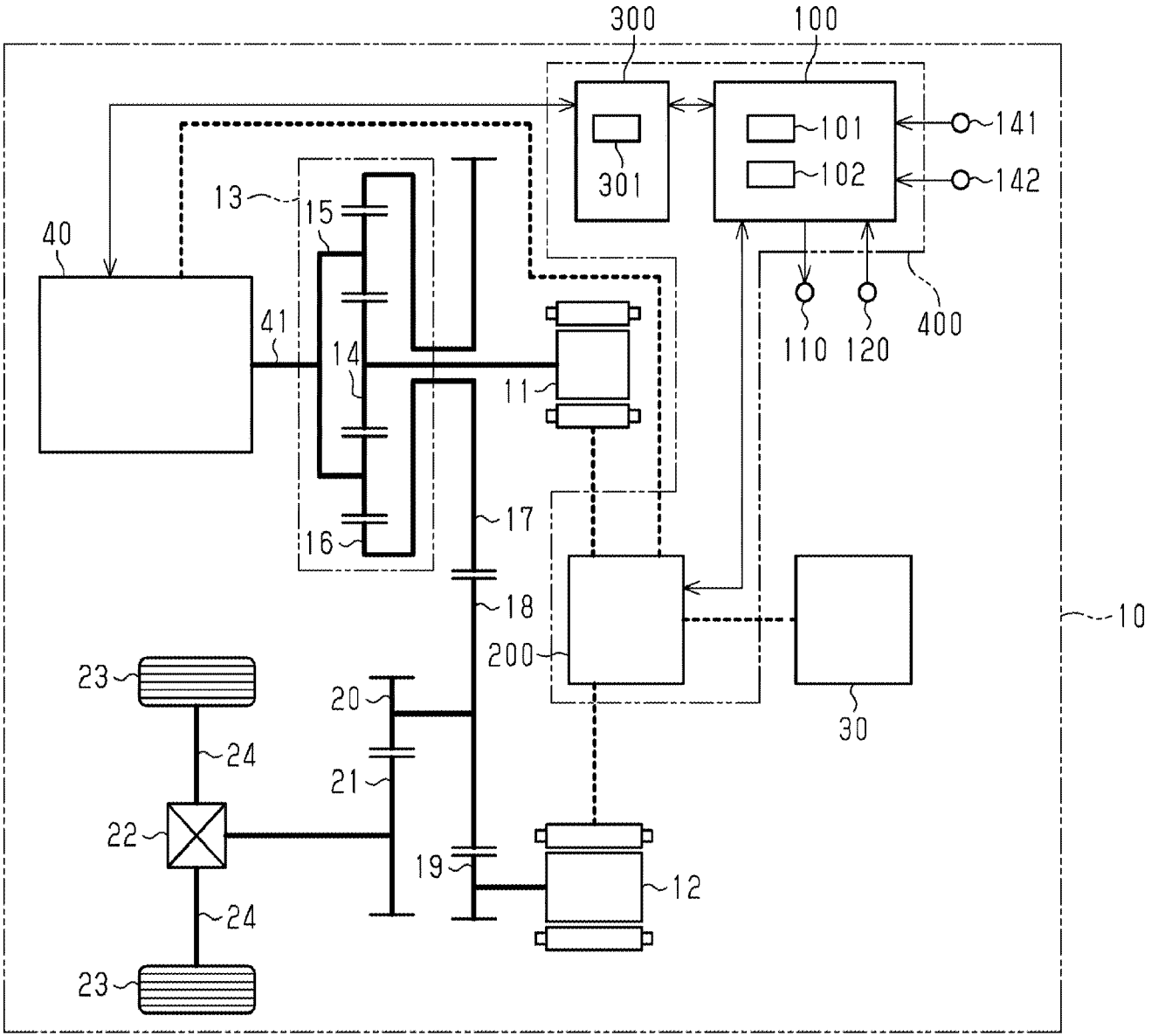
FIG. 1 is a schematic diagram showing the relationship between a controller of the present disclosure and a hybrid vehicle.

As shown in FIG. 1, the vehicle 10 includes an internal combustion engine 40. The vehicle 10 also includes a battery 30, which stores power. The vehicle 10 further includes a first motor-generator 11 and a second motor-generator 12. The first motor-generator 11 and the second motor-generator 12 are each a motor that generates a driving force in response to supply of power from the battery 30 and also functions as a generator that receives external force to generate power with which the battery 30 is charged.

The vehicle 10 is provided with a planetary gear mechanism 13, which includes three rotational elements: a sun gear 14, a planetary carrier 15, and a ring gear 16. The planetary carrier 15 of the planetary gear mechanism 13 is coupled to a crankshaft 41, which is the output shaft of the internal combustion engine 40. The sun gear 14 of the planetary gear mechanism 13 is coupled to the first motor-generator 11. The ring gear 16 of the planetary gear mechanism 13 is provided integrally with a counter drive gear 17. The counter drive gear 17 is meshed with a counter-driven gear 18. The second motor-generator 12 is coupled to a reduction gear 19, which is meshed with the counter-driven gear 18.

A final drive gear 20 is coupled to the counter-driven gear 18 so as to rotate integrally with the counter-driven gear 18. The final drive gear 20 is meshed with a final driven gear 21. The final driven gear 21 is coupled to drive shafts 24 of wheels 23 via a differential mechanism 22.

The controller 400, which controls the vehicle 10, includes a system control unit 100, a power control unit 200, and an engine control unit 300.

The first motor-generator 11 and the second motor-generator 12 are connected to the battery 30 via the power control unit 200, which is connected to the system control unit 100. The power control unit 200 includes a control section, an inverter, and a converter. On the basis of commands from the system control unit 100, the power control unit 200 regulates the amount of power supplied to the first motor-generator 11 and the second motor-generator 12 from the battery 30 and the amount of power from the first motor-generator 11 and the second motor-generator 12 with which the battery 30 is charged.

The system control unit 100 is also connected to the engine control unit 300, which controls the internal combustion engine 40. The engine control unit 300 controls the internal combustion engine 40 on the basis of commands from the system control unit 100.

Next, the fuel supply systems of the internal combustion engine 40 will now be described with reference to FIG. 2.

The fuel supply systems of the internal combustion engine 40 include port injection valves 43 and direct injection valves 44. The port injection valves 43 inject fuel into intake air flowing in the intake ports of the internal combustion engine 40. The direct injection valves 44 inject fuel into intake air in the cylinders of the internal combustion engine 40. The internal combustion engine 40 is an inline four-cylinder engine. Thus, the internal combustion engine 40 has four port injection valves 43 and four direct injection valves 44.

Figure 2:
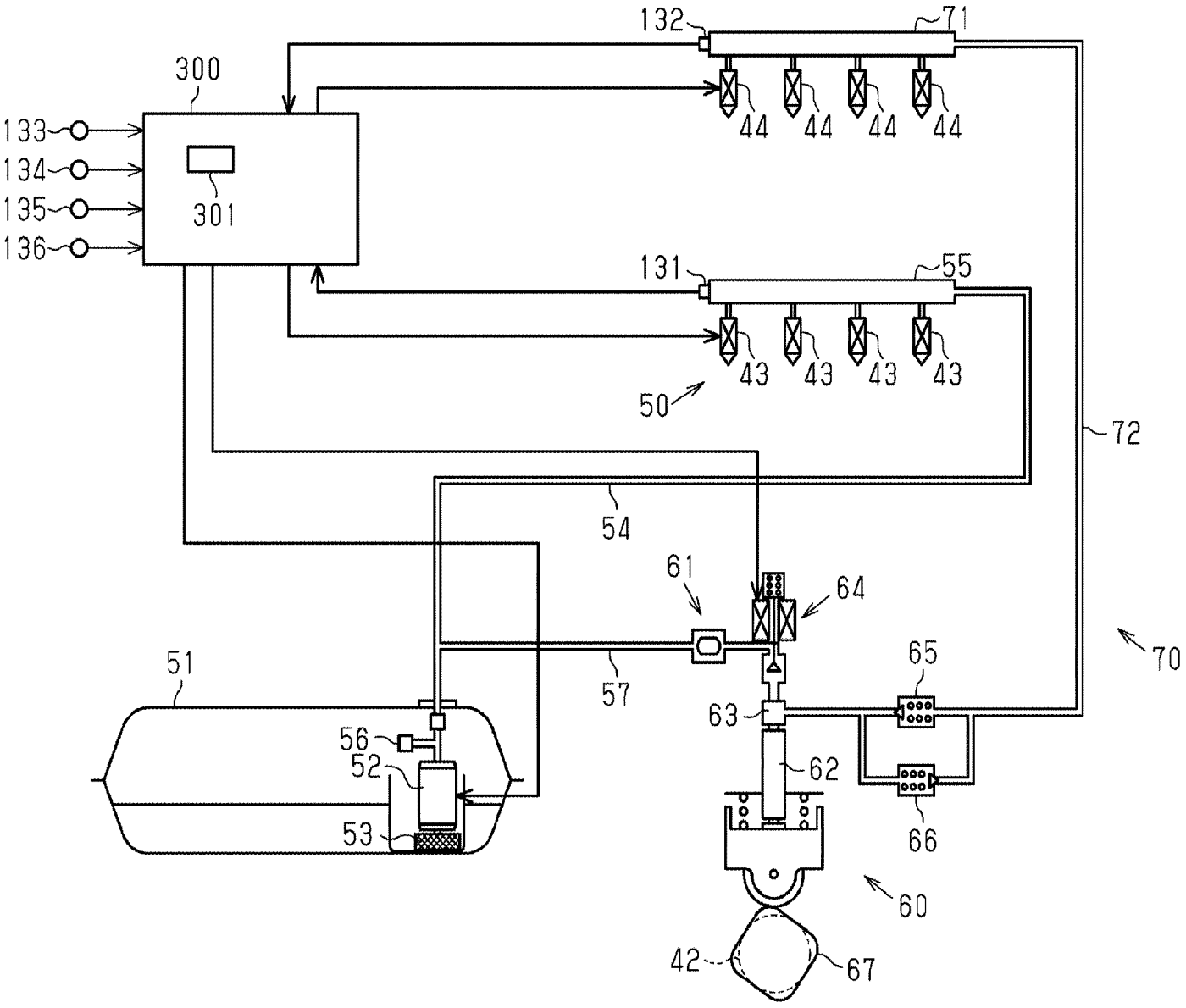
FIG. 2 is a schematic diagram showing the configuration of the fuel supply system of the internal combustion engine in the vehicle of FIG. 1.

As shown in FIG. 2, the internal combustion engine 40 includes two fuel supply systems, which are a low-pressure fuel supply system 50, which supplies fuel to the port injection valves 43, and a high-pressure fuel supply system 70, which supplies fuel to the direct injection valves 44.

A fuel tank 51 incorporates a feed pump 52. The feed pump 52 pumps fuel stored in the fuel tank 51 via a filter 53, which filters out purities in the fuel. The feed pump 52 supplies the fuel to a low-pressure-side delivery pipe 55 via a low-pressure fuel passage 54. The low-pressure-side delivery pipe 55 is connected to the respective port injection valves 43. The low-pressure-side delivery pipe 55 has a low-pressure-side fuel pressure sensor 131, which detects the pressure of fuel stored in the low-pressure-side delivery pipe 55. That is, the low-pressure-side fuel pressure sensor 131 detects the fuel pressure on the low pressure side, which is the pressure of the fuel supplied to the respective port injection valves 43. The low-pressure-side fuel pressure sensor 131 shows a fuel pressure as a gauge pressure, which is defined with reference to the atmospheric pressure.

A pressure regulator 56 is provided in the low-pressure fuel passage 54 in the fuel tank 51. When the pressure of fuel in the low-pressure fuel passage 54 exceeds a specified regulator-set pressure, the pressure regulator 56 opens to discharge fuel in the low-pressure fuel passage 54 to the fuel tank 51. In this manner, the pressure regulator 56 maintains the pressure of fuel supplied to the port injection valves 43 at a value lower than or equal to the regulator-set pressure.

The high-pressure fuel supply system 70 includes a mechanical high-pressure fuel pump 60. The low-pressure fuel passage 54 is connected to the high-pressure fuel pump 60 by a branch passage 57, which branches off the middle of the low-pressure fuel passage 54. The high-pressure fuel pump 60 is connected to a high-pressure-side delivery pipe 71, to which the direct injection valves 44 of the respective cylinders are connected, via a connection passage 72. The high-pressure fuel pump 60 is driven by the force of the internal combustion engine 40 to draw fuel from the low-pressure fuel passage 54, pressurize the fuel, and pressure-feed the fuel to the high-pressure-side delivery pipe 71. That is, the high-pressure-side delivery pipe 71 is a delivery pipe that stores high-pressure fuel pressurized by the high-pressure fuel pump 60. The direct injection valves 44, which are connected to the high-pressure-side delivery pipe 71, inject fuel stored in the high-pressure-side delivery pipe 71.

The high-pressure fuel pump 60 includes a pulsation dampener 61, a plunger 62, a fuel chamber 63, an electromagnetic spill valve 64, a check valve 65, and a relief valve 66. The plunger 62 reciprocates by being driven by a pump cam 67 provided on a camshaft 42 of the internal combustion engine 40, thereby changing the volume of the fuel chamber 63 in accordance with the reciprocation. The camshaft 42 is the intake-side camshaft, which drives the intake valves of the internal combustion engine 40, and the pump cam 67 is provided on the camshaft 42.

When energized, the electromagnetic spill valve 64 is closed to shut off the flow of fuel between the fuel chamber 63 and the low-pressure fuel passage 54. When the electromagnetic spill valve 64 has ceased being energized, it is opened to allow fuel to flow between the fuel chamber 63 and the low-pressure fuel passage 54. The check valve 65 prohibits backflow of fuel from the high-pressure-side delivery pipe 71 to the fuel chamber 63, while allowing fuel to be discharged to the high-pressure-side delivery pipe 71 from the fuel chamber 63. The relief valve 66 is provided in a passage that bypasses the check valve 65 to protect the high-pressure fuel supply system 70. When the pressure in a section between the relief valve 66 and the high-pressure-side delivery pipe 71 is excessively high, the relief valve 66 opens to allow for backflow of fuel from the high-pressure-side delivery pipe 71 to the fuel chamber 63.

When the plunger 62 moves in a direction of increasing the volume of the fuel chamber 63, the high-pressure fuel pump 60 opens the electromagnetic spill valve 64 to draw fuel in the low-pressure fuel passage 54 into the fuel chamber 63. When the plunger 62 moves in a direction of reducing the volume of the fuel chamber 63, the high-pressure fuel pump 60 closes the electromagnetic spill valve 64 to pressurize the fuel drawn into the fuel chamber 63 and discharge the fuel to the high-pressure-side delivery pipe 71.

In the following description, the movement of the plunger 62 in the direction of increasing the volume of the fuel chamber 63 will be referred to as descending of the plunger 62. The movement of the plunger 62 in the direction of reducing the volume of the fuel chamber 63 will be referred to as ascending of the plunger 62. In the internal combustion engine 40, the fuel discharge amount of the high-pressure fuel pump 60 is regulated by changing the ratio of the amount of time the electromagnetic spill valve 64 is open to the amount of time during which the plunger 62 ascends.

The branch passage 57, which branches off the low-pressure fuel passage 54 to be connected to the high-pressure fuel pump 60, is connected to the pulsation dampener 61, which dampens pressure pulsation of fuel caused by operation of the high-pressure fuel pump 60. The pulsation dampener 61 is connected to the fuel chamber 63 via the electromagnetic spill valve 64.

The high-pressure-side delivery pipe 71 has a high-pressure-side fuel pressure sensor 132, which detects the pressure of fuel stored in the high-pressure-side delivery pipe 71. That is, the high-pressure-side fuel pressure sensor 132 detects the fuel pressure on the high pressure side, which is the pressure of the fuel supplied to the respective direct injection valves 44. The fuel pressure of the high-pressure-side fuel pressure sensor 132 is shown by a gauge pressure with reference to the atmospheric pressure.

The engine control unit 300 of the controller 400 controls the internal combustion engine 40 by controlling the throttle valve and the ignition plugs in addition to the port injection valves 43, the direct injection valves 44, and the electromagnetic spill valve 64 of the high-pressure fuel pump 60.

As shown in FIG. 1, the system control unit 100 of the controller 400 receives a detection signal indicating the amount the accelerator s depressed by the driver from an accelerator position sensor 142. The system control unit 100 also receives a detection signal indicating the vehicle speed, which is the traveling speed of the vehicle 10, from a vehicle speed sensor 141.

Furthermore, the controller 400 receives detection signals from various types of other sensors. For example, as shown in FIG. 2, the engine control unit 300 is connected to an air flowmeter 133, a crank position sensor 134, a cam position sensor 135, and a coolant temperature sensor 136, in addition to the low-pressure-side fuel pressure sensor 131 and the high-pressure-side fuel pressure sensor 132.

The air flowmeter 133 detects the temperature of air drawn into the cylinders through the intake passage of the internal combustion engine 40 and the intake air amount, which is the mass of the drawn-in air. The crank position sensor 134 outputs a crank angle signal, which corresponds to changes in the rotational phase of the crankshaft 41. The cam position sensor 135 outputs a cam angle signal, which corresponds to changes in the rotational phase of the camshaft 42. The coolant temperature sensor 136 detects the coolant temperature, which is the temperature of the coolant of the internal combustion engine 40.

The engine control unit 300 receives detection signals of the above sensors. The engine control unit 300 calculates an engine rotational speed, which is the rotational speed of the crankshaft 41, based on a detection signal of the rotational angle of the crankshaft 41 delivered by the crank position sensor 134.

As shown in FIG. 1, a main switch 120 is connected to the system control unit 100 of the controller 400. The power control unit 200 of the controller 400 receives the current, the voltage, and the temperature of the battery 30. Based on the current, the voltage, and the temperature, the power control unit 200 calculates a state-of-charge index value SOC, which is the ratio of the remaining charge to the battery charging capacity.

The engine control unit 300 and the power control unit 200 are each connected to the system control unit 100. The system control unit 100, the power control unit 200, and the engine control unit 300 exchange and share calculated information and information based on detection signals from sensors at various locations.

Based on the information, the system control unit 100 outputs commands to the engine control unit 300 to control the internal combustion engine 40 through the engine control unit 300. Also, based on the information, the system control unit 100 outputs commands to the power control unit 200 to control the first motor-generator 11 and the second motor-generator 12, and control charging of the battery 30 through the power control unit 200. In this manner, the system control unit 100 controls the vehicle 10 by outputting commands to the power control unit 200 and the engine control unit 300.

Next, control of the vehicle 10 performed by the controller 400, which includes the system control unit 100, the power control unit 200, and the engine control unit 300, will be described.

The system control unit 100 calculates a requested output, which is a requested value of the output of the vehicle 10, based on the amount the accelerator is depressed and the vehicle speed. The system control unit 100 determines the torque distribution of the internal combustion engine 40, the first motor-generator 11, and the second motor-generator 12 in accordance with parameters such as the requested output and the state-of-charge index value SOC of the battery 30. The system control unit 100 further controls the output of the internal combustion engine 40 and powering operation/regenerative operation performed by the first motor-generator 11 and the second motor-generator 12.

For example, the system control unit 100 causes the first motor-generator 11 to operate as a starter motor when starting the internal combustion engine 40. Specifically, the system control unit 100 causes the first motor-generator 11 to rotate the sun gear 14 to rotate the crankshaft 41, thereby starting the internal combustion engine 40.

Also, the system control unit 100 switches the control when stopping the vehicle in accordance with the magnitude of the state-of-charge index value SOC. Specifically, when the state-of-charge index value SOC is greater than or equal to a threshold, the system control unit 100 stops the operation of the internal combustion engine 40 and does not drive the first motor-generator 11 and the second motor-generator 12. That is, the system control unit 100 stops the operation of the internal combustion engine 40 when the vehicle is stopped, thereby restricting idling. When the state-of-charge index value SOC of the battery 30 is less than the threshold, the system control unit 100 causes the internal combustion engine 40 to operate and uses the output of the internal combustion engine 40 to drive the first motor-generator 11. That is, the first motor-generator 11 is caused to function as a generator.

The system control unit 100 also switches the control when the vehicle is traveling in accordance with the state-of-charge index value SOC. At the starting of the vehicle 10 or during traveling of the vehicle 10 under light load, if the state-of-charge index value SOC of the battery 30 is greater than or equal to the threshold, the system control unit 100 starts the vehicle 10 or causes the vehicle 10 to travel by using only the driving force of the second motor-generator 12. In this case, the internal combustion engine 40 is in a stopped state, and the first motor-generator 11 does not generate power. In contrast, at the starting of the vehicle 10 or during traveling under light load, if the state-of-charge index value SOC of the battery 30 is less than the threshold, the system control unit 100 starts the internal combustion engine 40 to generate power using the first motor-generator 11 and charges the battery 30 with the generated power. At this time, the vehicle 10 travels by using some of the driving force of the internal combustion engine 40 and the driving force of the second motor-generator 12.

When the state-of-charge index value SOC of the battery 30 is greater than or equal to the threshold in a steady traveling state, the system control unit 100 causes the internal combustion engine 40 to operate in a state of a high operating efficiency and causes the vehicle 10 to travel mainly using the output of the internal combustion engine 40. At this time, the force of the internal combustion engine 40 is divided into a portion supplied to the driven wheels 23 and a portion supplied to the first motor-generator 11 by the planetary gear mechanism 13. Accordingly, the vehicle 10 travels while generating power with the first motor-generator 11. The system control unit 100 uses the generated power to drive the second motor-generator 12 and uses the force of the second motor-generator 12 to assist the force of the internal combustion engine 40. In contrast, when the state-of-charge index value SOC of the battery 30 is less than the threshold in a steady traveling state, the system control unit 100 further increases the engine rotational speed. The system control unit 100 uses the power generated by the first motor-generator 11 to drive the second motor-generator 12 and charges the battery 30 with the excess power.

During acceleration of the vehicle 10, the system control unit 100 increases the engine rotational speed and uses the power generated by the first motor-generator 11 to drive the second motor-generator 12. That is, the system control unit 100 accelerates the vehicle 10 using the force of the internal combustion engine 40 and the force of the second motor-generator 12.

When decelerating the vehicle 10, the system control unit 100 stops the operation of the internal combustion engine 40. The system control unit 100 then causes the second motor-generator 12 to operate as a generator and charges the battery 30 with the generated power. The vehicle 10 uses the resistance produced through such power generation as a braking force (regenerative braking). Such power generation control during the vehicle deceleration is referred to as regeneration control.

In this manner, the system control unit 100 stops the internal combustion engine 40 depending on the situation. That is, the system control unit 100 executes intermittent stop control to automatically stop and restart the internal combustion engine 40 depending on the situation.

The engine control unit 300 calculates a crank counter, which indicates the crank angle, or the rotational phase of the crankshaft 41. The engine control unit 300 calculates the crank counter on the basis of the crank angle signal, which is output by the crank position sensor 134, and a cam angle signal, which is output by the cam position sensor 135. The engine control unit 300 refers to the calculated crank counter to control the timing of fuel injection and ignition for each cylinder.

Specifically, the engine control unit 300 calculates a target fuel injection amount, which is a control target value for the fuel injection amount, based on parameters such as the amount the accelerator is depressed, the vehicle speed, the intake air amount, the engine rotational speed, and the engine load factor. The engine load factor is the ratio of the inflow air amount per combustion cycle of one cylinder to a reference inflow air amount. The reference inflow air amount is the inflow air amount per combustion cycle of one cylinder when the opening degree of the throttle valve is maximized and is determined in accordance with the engine rotation speed. Basically, the engine control unit 300 calculates the target fuel injection amount such that the air-fuel ratio becomes the stoichiometric air-fuel ratio. The engine control unit 300 calculates control target values of the injection timing and fuel injection duration for the port injection valves 43 and the direct injection valves 44. The port injection valves 43 and the direct injection valves 44 are actuated to open by the engine control unit 300 in accordance with the control target values. Accordingly, an amount of fuel that corresponds to the operating state of the internal combustion engine 40 is injected to be supplied to the combustion chambers of the internal combustion engine 40. The internal combustion engine 40 switches between fuel injection from the port injection valves 43 and fuel injection from the direct injection valves 44 depending on the operating state. Thus, the internal combustion engine 40 injects from both of the port injection valves 43 and the direct injection valves 44, only from the port injection valves 43, or only from the direct injection valves 44.

The engine control unit 300 also executes fuel cutoff control in order to reduce the fuel consumption rate during deceleration when the accelerator is not depressed (depressed in an amount of zero). That is, in the fuel cutoff control, the injection of fuel is stopped, so that the supply of fuel to the combustion chambers of the internal combustion engine 40 is stopped. Further, the engine control unit 300 calculates the ignition timing, which is the timing of spark discharge by the ignition plugs, and operates the ignition plugs to ignite air-fuel mixture.

The controller 400 performs the rationality check when the operation of the vehicle 10 is stopped by turning the main switch 120 off. The rationality check determines whether the high-pressure-side fuel pressure sensor 132 can accurately detect the fuel pressure in the high-pressure-side delivery pipe 71.

Thus, as shown in FIG. 1, the engine control unit 300 of the controller 400 has a determining section 301, which performs the rationality check. The system control unit 100 of the controller 400 includes a soak timer 101 and a nonvolatile memory 102.

While the main switch 120 is off, the soak timer 101 measures the amount of time elapsed since the main switch 120 was turned off. The soak timer 101 activates the controller 400 when the measured amount of time reaches the specified amount of time. When activated by the soak timer 101 in this manner, the determining section 301 performs the rationality check if the operation of the vehicle 10 is stopped by turning the main switch 120 off.

The nonvolatile memory 102 is capable of retaining information when the main switch 120 is off and no power is supplied to the nonvolatile memory 102. The controller 400 causes the nonvolatile memory 102 to store information used in the rationality check.

The internal combustion engine 40 is sealed when the main switch 120 of the vehicle 10 is off, so that the operation of the internal combustion engine 40 is stopped. Thus, due to the reduction in the volume of the fuel that accompanies the decrease in the fuel temperature from the point in time when the main switch 120 was turned off, the fuel pressure in the high-pressure-side delivery pipe 71 decreases. However, as the fuel pressure decreases due to the decrease in the fuel temperature, some of the fuel evaporates, so that bubbles may be generated in the fuel in the high-pressure-side delivery pipe 71. If bubbles exist, the fuel pressure is unlikely to decrease even if the fuel temperature decreases. Then, at equilibrium, the fuel pressure converges to a value in the vicinity of 0 MPa.

The controller 400 uses the soak timer 101 to measure the amount of time elapsed since the main switch 120 was turned off in a state in which the fuel temperature is thus sufficiently high due to operation of the internal combustion engine 40. By measuring the elapsed amount of time using the soak timer 101, the controller 400 waits for the elapse of an amount of time required for the fuel pressure to decrease to a value in the vicinity of 0 MPa. Since the controller 400 is activated when the elapsed amount of time measured by the soak timer 101 reaches the specified amount of time, it is assumed that the fuel pressure has decreased to a value in the vicinity of 0 MPa. The determining section 301 then performs the rationality check. Specifically, the determining section 301 uses the high-pressure-side fuel pressure sensor 132 to detect the fuel pressure in the high-pressure-side delivery pipe 71 and determines whether the detected pressure is in a normal range. The normal range has a certain deviation above and below the 0 MPa, which serves as the central value.

The determining section 301 performs the rationality check in the above-described manner. Thus, if the fuel pressure detected by the high-pressure-side fuel pressure sensor 132 is out of the normal range, the determining section 301 determines that there is an anomaly in the high-pressure-side fuel pressure sensor 132.

As shown in FIG. 1, the vehicle 10 includes a warning display section 110, which notifies vehicle occupants of the occurrence of an anomaly in the high-pressure-side fuel pressure sensor 132 by displaying an icon as information indicating the occurrence of the anomaly. Thus, when the determining section 301 determines that an anomaly has occurred, the system control unit 100 causes the warning display section 110 to display the icon indicating the occurrence of the anomaly.

The rationality check will now be described with reference to FIGS. 3 to 6.

Figure 3:
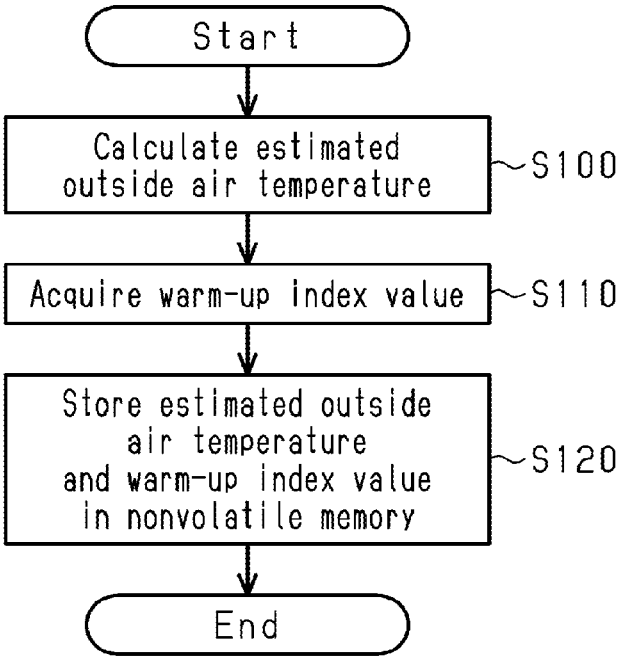
FIG. 3 is a flowchart showing the procedure of a routine for storing index values used in a rationality check in a nonvolatile memory of the vehicle of FIG. 1.

When the main switch 120 is turned off, the controller 400 executes the routine of FIG. 3 in preparation for the rationality check until the power supply to the controller 400 is stopped by the execution of a process for stopping the system of the vehicle 10. Specifically, the routine shown in FIG. 3 is executed by the determining section 301 of the engine control unit 300 when the crankshaft 41 of the internal combustion engine 40 is stopped. This routine is executed on a condition that information indicating the occurrence of an anomaly in the high-pressure-side fuel pressure sensor 132 is not stored in the nonvolatile memory 102.

When the routine is started, the determining section 301 calculates an estimated outside air temperature in step S100 as shown in FIG. 3. The estimated outside air temperature is calculated as a first index value of the vehicle outside temperature during the time that the internal combustion engine 40 has been operating during the current trip, which is until the main switch 120 is turned off. The term "trip" refers to a period during which the main switch 120 of the vehicle 10 is on, that is, the period during which the operation of the controller 400 of the vehicle 10 is continuing.

In step S100, the determining section 301 calculates, as the estimated outside air temperature, the lower one of the minimum value of the temperature of the intake air during the current trip and the coolant temperature at the first starting of the internal combustion engine 40 during the current trip.

Next, the determining section 301 acquires a warm-up index value in step S110. The warm-up index value indicates the extent of warm-up and increases as the extent of warm-up of the internal combustion engine 40 becomes higher. When the controller 400 is operating due to the main switch 120 being on, the system control unit 100 calculates the warm-up index value. As the cumulative intake air amount increases, the heat generated by the internal combustion engine 40 tends to increase. Thus, as the cumulative intake air amount increases, the extent of warm-up becomes higher. As such, the system control unit 100 of the controller 400 calculates, as a warm-up index value, the cumulative intake air amount, which is a cumulative value of the intake air amount. In step S110, the determining section 301 acquires the warm-up index value calculated by the system control unit 100.

In the subsequent step S120, the determining section 301 stores the estimated outside air temperature and the warm-up index value in the nonvolatile memory 102 of the system control unit 100. When the estimated outside air temperature and the warm-up index value, which are used in the rationality check, are stored in the nonvolatile memory 102, the determining section 301 ends the routine.

Figure 4:
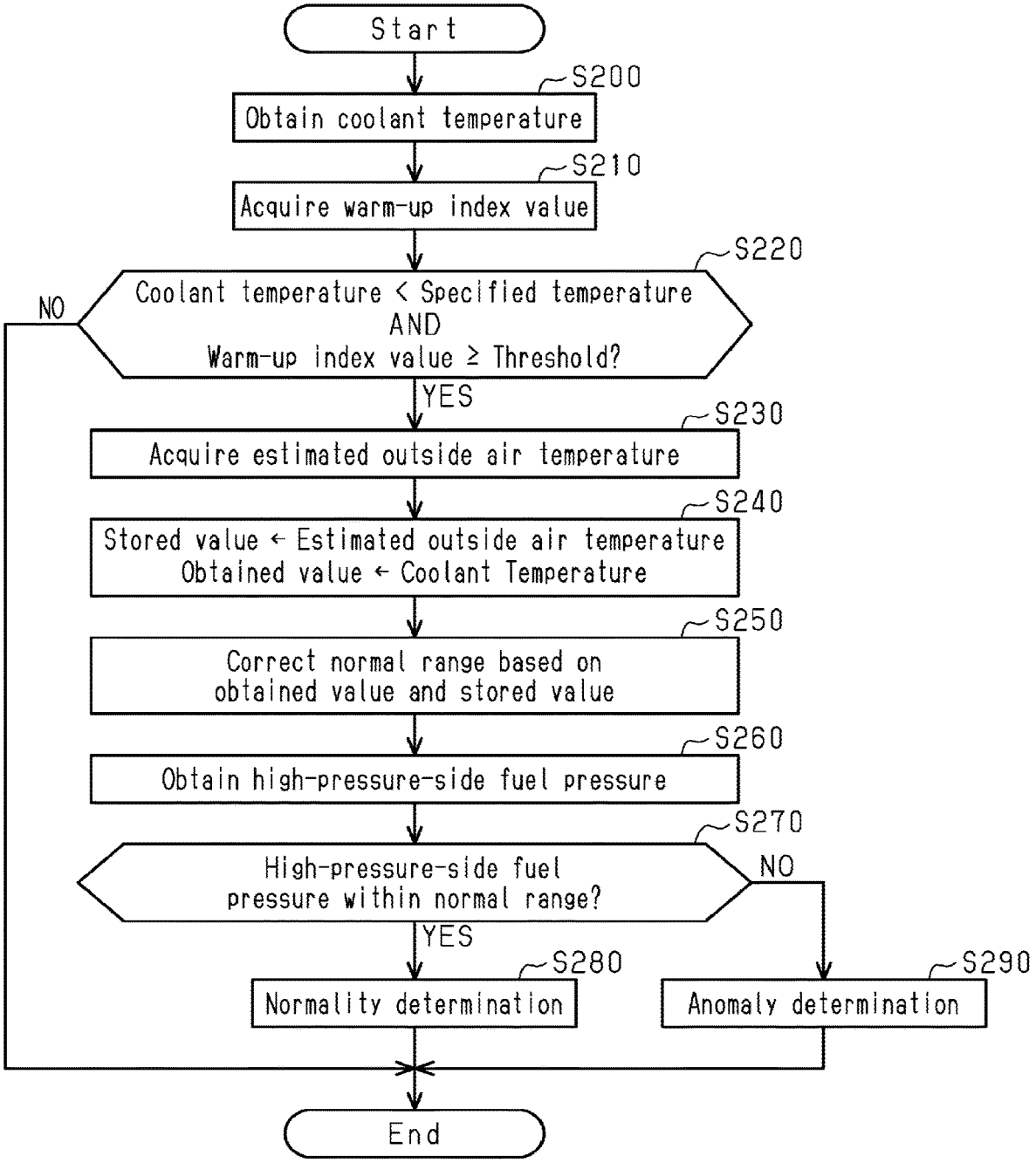
FIG. 4 is a flowchart showing the procedure of a routine related to the rationality check in the vehicle of FIG. 1.

As described above, the soak timer 101 measures the amount of time elapsed since the main switch 120 was turned off while the main switch 120 is off. Since the controller 400 is activated when the elapsed amount of time measured by the soak timer 101 reaches the specified amount of time, the determining section 301 executes the routine shown in FIG. 4. The controller 400 has two or more specified amounts of time having different lengths. Specifically, the controller 400 has a first specified amount of time, a second specified amount of time, and a third specified amount of time having progressively increasing amounts of time from the first to the third amount of time. When the elapsed amount of time since the main switch 120 was turned off reaches the first specified amount of time, the controller 400 is activated, so that the routine shown in FIG. 4 is executed by the determining section 301. The specified amounts of time are in units of hours.

The soak timer 101 measures time on a condition that information indicating the occurrence of an anomaly in the high-pressure-side fuel pressure sensor 132 is not stored in the nonvolatile memory 102. Thus, the routine shown in FIG. 4 is also executed on the condition that information indicating the occurrence of an anomaly in the high-pressure-side fuel pressure sensor 132 is not stored in the nonvolatile memory 102.

As shown in FIG. 4, when starting this routine, the determining section 301 first obtains the coolant temperature, which is detected by the coolant temperature sensor 136, in step S200. That is, the determining section 301 obtains the current coolant temperature detected by the coolant temperature sensor 136.

Next, the determining section 301 acquires the warm-up index value stored in the nonvolatile memory 102 in step S102. After acquiring the coolant temperature and reading in the warm-up index value, the determining section 301 proceeds to step S220.

In step S220, the determining section 301 determines whether the performance condition for the rationality check is met. The controller 400 uses, as the performance condition for the rationality check, the logical conjunction of (ii) the coolant temperature acquired in step S200 being lower than a specified temperature and (i) the warm-up index value acquired in step S210 being greater than or equal to a threshold. The specified temperature is set to be lower than a warm-up completion temperature, which is the threshold for determining whether the warm-up of the internal combustion engine 40 has been completed. When the warm-up completion temperature is, for example, 80° C., the specified temperature is, for example, 50° C. The magnitude of the threshold of the warm-up index value is set such that the following determination is possible. The threshold of the warm-up index value is set to a value that allows for determination, based on the warm-up index value being greater than or equal to the threshold, that the fuel temperature of the internal combustion engine 40 has been raised by the engine warm-up to an extent that ensures a fuel temperature decrease amount required for performing the rationality check. That is, the performance condition for the rationality check is designed to confirm that (i) the fuel temperature when the main switch 120 is turned off is relatively high, and (ii) the current fuel temperature has decreased a certain extent. Therefore, if the performance condition is met, it can be assumed that the fuel temperature has decreased a certain extent from a state of being relatively high. The condition is suitable for performing the rationality check of the high-pressure-side fuel pressure sensor 132.

When determining that the performance condition is met in step S200, that is, when determining that (ii) the coolant temperature is lower than the specified temperature and (i) the warm-up index value is greater than or equal to the threshold (step S220: YES), the determining section 301 proceeds to step S230. The determining section 301 performs the rationality check, which includes steps S230 to S290.

In contrast, when determining that the performance condition is not met in step S220 (step S220: NO), the determining section 301 ends the current routine without performing the rationality check. In this case, the operation of the controller 400 is stopped. Thereafter, when the amount of time elapsed since the main switch 120 was turned off, which is continuously measured by the soak timer 101, reaches the second amount of time, which is the next specified amount of time, the controller 400 is activated again to execute this routine. In the same manner, the routine is ended without performing the rationality check when determination of step S220 is negative in a case in which the controller 400 is activated when the amount of time elapsed, which is measured by the soak timer 101, reaches the second amount of time. Then, when the amount of time elapsed reaches the third specified amount of time, the controller 400 is activated again to execute this routine.

When the process proceeds to step S230 and the rationality check is started, the determining section 301 first acquires the estimated outside air temperature stored in the nonvolatile memory 102 in step S230. Next, in step S240, the determining section 301 writes the acquired estimated outside air temperature to a stored value, thereby updating the stored value, and writes the coolant temperature obtained in step S200 to an obtained value, thereby updating the obtained value. The obtained value is used in the subsequent step S250 as a value that indicates a second index value of the vehicle outside temperature obtained when the elapsed amount of time reaches the specified amount of time so that the determining section 301 is activated. The stored value is used in the subsequent step S250 as the first index value of the vehicle outside temperature that is stored in the nonvolatile memory 102 before the main switch 120 is turned off so that the operation of the determining section 301 is stopped.

Figure 5:
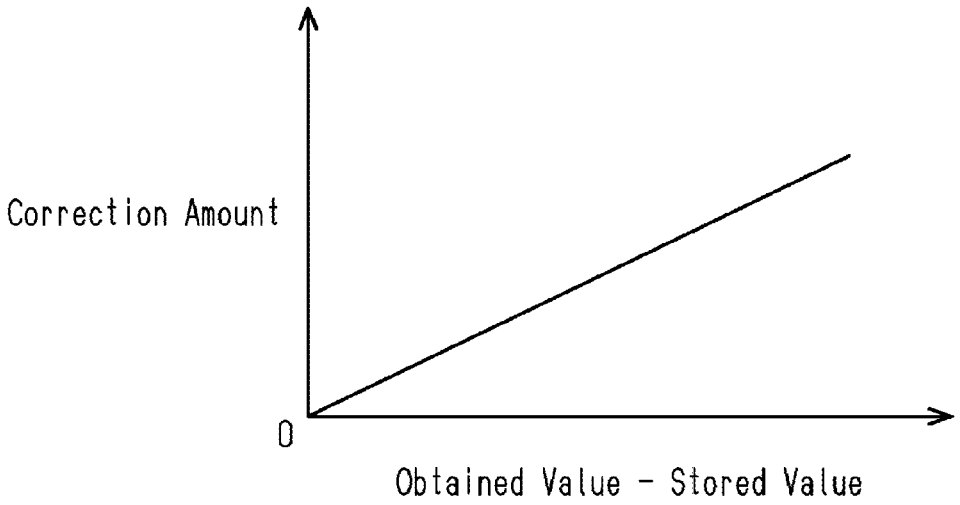
FIG. 5 is a graph showing the relationship between a correction amount in a correction process and a difference obtained by subtracting a stored value of the vehicle outside temperature from an obtained value of the vehicle outside temperature in the vehicle of FIG. 1.

In the subsequent step S250, the determining section 301 executes a correction process for correcting the normal range used in the rationality check based on the updated obtained value and stored value. Specifically, as shown in FIG. 5, in the correction process, the determining section 301 calculates a greater value of a correction amount as the difference obtained by subtracting the stored value from the obtained value increases, and corrects, or shifts, the normal range toward the high pressure side by the correction amount. That is, the determining section 301 adds the correction amount to both of the upper limit and the lower limit of the normal range to shift the normal range toward the high pressure side. This increases the median of the correction range from 0 MPa by the correction amount.

When the normal range used in the rationality check is corrected through the correction process of step S250, the determining section 301 then obtains, in step S260, the fuel pressure in the high-pressure-side delivery pipe 71, which has been detected by the high-pressure-side fuel pressure sensor 132. That is, the determining section 301 obtains the current fuel pressure in the high-pressure-side delivery pipe 71, which has been detected by the high-pressure-side fuel pressure sensor 132.

Then, in the subsequent step S270, the determining section 301 determines whether the obtained fuel pressure on the high pressure side is within the corrected normal range.

When determining that the fuel pressure on the high pressure side is within the corrected normal range in step S270 (step S270: YES), the determining section 301 proceeds to step S280. In step S280, the determining section 301 concludes the determination that the high-pressure-side fuel pressure sensor 132 is operating normally. The determining section 301 then resets the elapsed amount of time by stopping measuring time with the soak timer 101 and ends the rationality check.

When determining that the fuel pressure on the high pressure side is out of the corrected normal range in step S270 (step S270: NO), the determining section 301 proceeds to step S290. In step S290, the determining section 301 concludes the determination that there is an anomaly in the high-pressure-side fuel pressure sensor 132. As an anomaly determination process, the determining section 301 causes the nonvolatile memory 102 to store information indicating that there is an anomaly. The determining section 301 then resets the elapsed amount of time by stopping measuring time with the soak timer 101 and ends the rationality check.

When the nonvolatile memory 102 stores information that indicates that there is an anomaly, the system control unit 100 causes the warning display section 110 to display an icon that indicates the existence of the anomaly to notify the vehicle occupants of the existence of the anomaly. The information indicating that there is an anomaly, which is stored in the nonvolatile memory 102, is deleted from the nonvolatile memory 102 when the anomaly is eliminated by repairing the high-pressure-side fuel pressure sensor 132, for example, at a repair shop. Therefore, after it is determined that there is an anomaly through the rationality check, because the information indicating the anomaly is stored in the nonvolatile memory 102, the warning display section 110 continues displaying the icon indicating the existence of the anomaly until the information is deleted through repair.

When step S280 or step S290 is finished, the determining section 301 ends the current routine. Accordingly, the operation of the controller 400 is stopped.

After the rationality check is finished in step S280 or step S290, the soak timer 101 does not activate the controller 400 while a state in which the main switch 120 is off is continuing. That is, the rationality check is not performed in the controller 400 while a state in which the main switch 120 is off is continuing after the rationality check is completed once.

Figure 6:
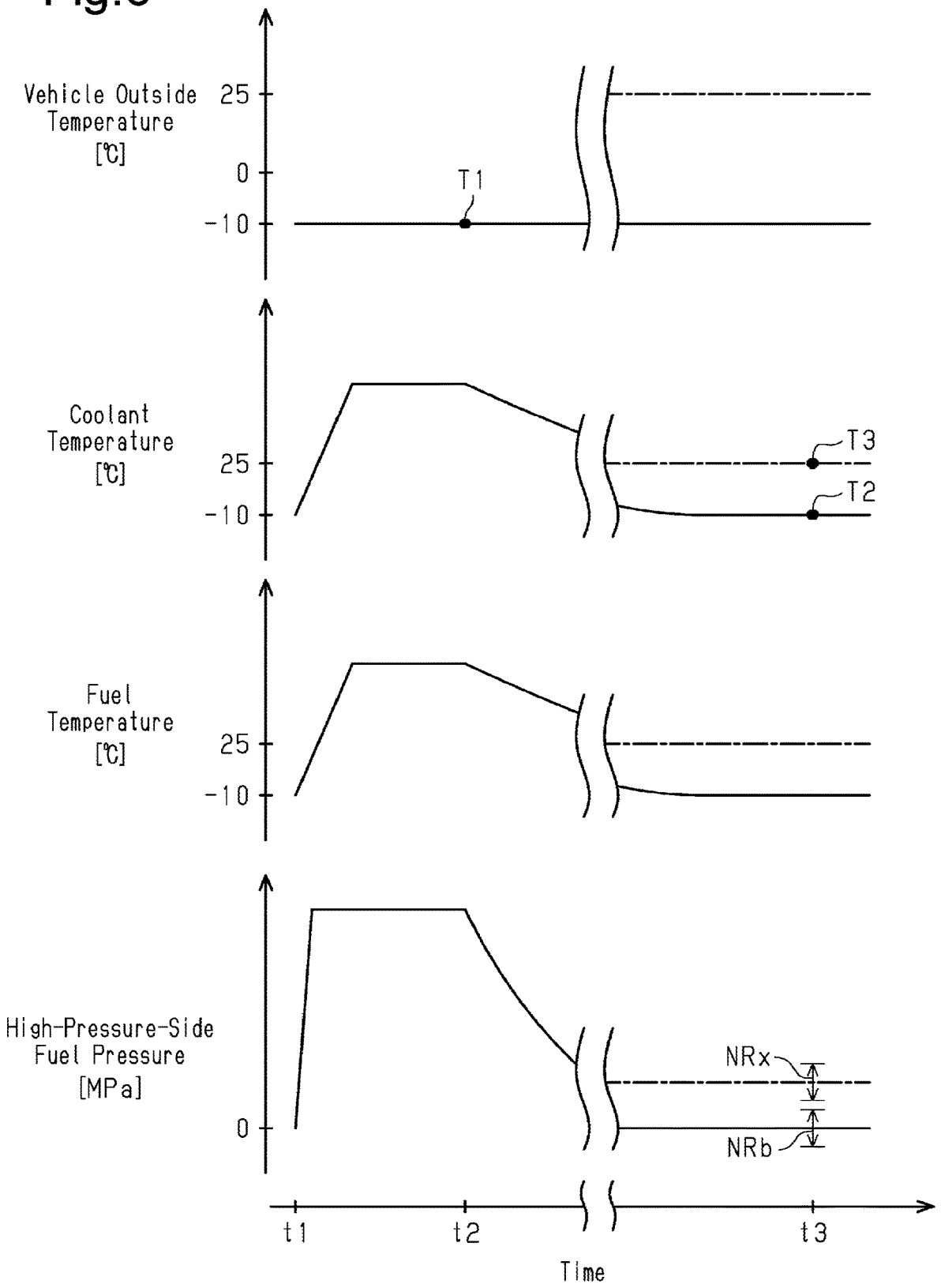
FIG. 6 is a timing diagram showing changes in the vehicle outside temperature, the coolant temperature, the fuel temperature, and the fuel pressure on a high pressure side in the vehicle of FIG. 1.

The operation of the present embodiment will be now described with reference to FIG. 6. FIG. 6 is a timing diagram showing changes in the vehicle outside temperature, the coolant temperature, the fuel temperature, and the fuel pressure on the high pressure side after the main switch 120 is turned off.

As shown in FIG. 6, the internal combustion engine 40 is started at point in time t1 Once the internal combustion engine 40 starts operating, the high-pressure fuel pump 60 starts pressurization, so that the high-pressure-side fuel pressure, which is the fuel pressure in the high-pressure-side delivery pipe 71, increases to the target fuel pressure. While the internal combustion engine 40 is operating, the engine control unit 300 controls the fuel pressure.

As the internal combustion engine 40 operates, the fuel temperature, which is the temperature of the fuel in the high-pressure-side delivery pipe 71, increases together with the coolant temperature. FIG. 6 shows an example in which the vehicle outside temperature, which is the temperature of the outside in the environment in which the vehicle 10 is situated, is −10° C.

When the coolant temperature increases to or exceeds a warm-up determination temperature, the warm-up of the internal combustion engine 40 is completed. At this time, the radiator starts radiating heat. Thus, as shown in FIG. 6, the increase in the coolant temperature and the increase in the fuel temperature peak when reaching certain levels due to the cooling effect of the coolant and the heat radiating effect of the radiator.

During operation of the internal combustion engine 40, fuel, the temperature of which has increased due to the operation of the internal combustion engine 40, is stored in the high-pressure-side delivery pipe 71 at a high pressure, and is then injected from the direct injection valves 44.

When the main switch 120 is turned off at point in time t2, power supply to the controller 400 is stopped, so that the operation of the system of the vehicle 10 and the operation of the internal combustion engine 40 are stopped. When the operation of the internal combustion engine 40 is stopped, the heat due to combustion of fuel stops being generated, so that the coolant temperature and the fuel temperature gradually decrease. Also, while the internal combustion engine 40 is in a stopped state, the high-pressure-side delivery pipe 71 is sealed, so that the volume of the fuel stored in the high-pressure-side delivery pipe 71 decreases as the fuel temperature decreases. Accordingly, the high-pressure-side fuel pressure decreases as shown in FIG. 6.

As described above with reference to FIG. 3, the determining section 301 of the controller 400 stores, in the nonvolatile memory 102, the estimated outside air temperature as the first index value of the vehicle outside temperature. Accordingly, the temperature that corresponds to the temperature indicated by a point T1 in FIG. 6 is calculated as the estimated outside air temperature, and the calculated estimated outside air temperature is stored in the nonvolatile memory 102 as the first index value of the vehicle outside temperature. At this time, the warm-up index value is stored in the nonvolatile memory 102 together with the estimated outside air temperature.

Also, when the main switch 120 is turned off at the point in time t2, the soak timer 101 starts measuring time. Then, when the elapsed amount of time measured by the soak timer 101 reaches the first specified amount of time, the controller 400 is activated.

At the point in time t3, the determining section 301 executes the routine that has been described with reference to FIG. 4, thereby obtaining the coolant temperature as the second index value of the vehicle outside temperature. FIG. 6 shows an example in which the vehicle outside temperature at the point in time t3 is −10° C., and the vehicle outside temperature has not changed from −10° C. since the operation of the internal combustion engine 40 in the immediately preceding trip. In this case, the heat generated in the immediately preceding trip has been completely radiated, so that the coolant temperature and the fuel temperature both have converged to −10° C. Thus, the determining section 301 obtains the temperature indicted by a point T2 in FIG. 2 as the second index value of the vehicle outside temperature.

Also, since the volume of fuel has sufficiently decreased due to the decrease in the fuel temperature to −10° C., the high-pressure-side fuel pressure has converged to 0 MPa as indicted by the solid line.

In this example, the warm-up of the internal combustion engine 40 has been completed since the coolant temperature increased to or exceeded the warm-up determination temperature in the immediately preceding trip. Accordingly, the warm-up index value stored in the nonvolatile memory 102 is greater than or equal to the threshold. Also, the coolant temperature has decreased to −10° C. Thus, at this time, the performance condition for the rationality check is determined to be met, so that the determining section 301 performs the rationality check.

In the rationality check, the determining section 301 calculates the correction amount related to the normal range based on the stored value, which is the first index value of the vehicle outside temperature stored in the nonvolatile memory 102 at the point in time t2, and the obtained value, which is the second index value of the vehicle outside temperature obtained at the point in time t3. In this case, T1, which is the stored value, and T2, which is the obtained value, are both −10° C., so that there is no difference between the stored value and the obtained value. Since there is no difference between the first index value (the stored value T1) and the second index value (the obtained value T2), the second index value (T2) is not higher than the first index value (T1). Accordingly, the correction amount is 0 as shown in FIG. 6.

Thus, in this case, the correction through the correction process is not executed, so that the rationality check is performed by using a referential normal range NRb shown in FIG. 6 as the normal range without being changed. Since the high-pressure-side fuel pressure has converged to 0 MPa, the pressure detected by the high-pressure-side fuel pressure sensor 132 remains within the normal range indicated by NRb in FIG. 6 if the high-pressure-side fuel pressure sensor 132 is operating normally. That is, determination of the normal state is properly made.

If the vehicle outside temperature has changed and increased while the main switch 120 is off as indicated by the two dash line in FIG. 6, the coolant temperature and the fuel temperature can be unexpectedly high when the specified amount of time has elapsed. In such a case, an erroneous determination may be made if the normal range used in the rationality check remains the referential normal range NRb.

For example, a case is now considered in which the vehicle 10 has traveled at night in the winter and is parked in a garage. When the temperature in the garage increases due to the temperature increase during the next day, the vehicle outside temperature can change while the main switch 120 is off as indicated by the two dash line in FIG. 6. In this case, T1, which is the first index value of the vehicle outside temperature stored in the nonvolatile memory 102 is 10° C. at the point in time t2. The coolant temperature and the fuel temperature at the point in time t3 are both 25° C. As a result, the high-pressure-side fuel pressure at the point in time t3 has not decreased to a value in the vicinity of 0 MPa, so that the high-pressure-side fuel pressure may be out of the referential normal range NRb. Thus, if the rationality check is performed by using the referential normal range NRb as is, as in a comparative example, an erroneous determination of an anomaly will be made despite the fact that the high-pressure-side fuel pressure sensor 132 is operating normally.

However, in accordance with exemplary embodiments of the present invention, the controller 400 of the present embodiment obtains the coolant temperature (T3) as the second index value of the vehicle outside temperature at the point in time t3, at which the specified amount of time has elapsed. The controller 400 then calculates the correction amount based on the second index value (T3) of the obtained vehicle outside temperature and the first index value (T1) of the vehicle outside temperature stored in the nonvolatile memory 102. Further, the controller 400 executes the correction process for correcting the normal range by using the calculated correction amount.

In the example shown in FIG. 6, T1, which is the first index value of the vehicle outside temperature stored in the nonvolatile memory 102 at the point in time t2 is −10° C. That is, the stored value is −10° C. The temperature indicated by a point T3 is obtained at the point in time t3. Thus, T3, which is the second index value of the vehicle outside temperature obtained at the point in time t3, is 25° C. That is, the obtained value is 25° C. Thus, in the present example, the difference (T3−T1) obtained by subtracting the stored value from the obtained value is 35° C., and a correction amount corresponding to the difference is calculated. The normal range is corrected by the calculated correction amount. Accordingly, the corrected normal range NRx is on the high pressure side of the referential normal range NRb. That is, the normal range is shifted from referential NRb to NRx on the high pressure side.

That is, in the example indicated by the two dash lines in FIG. 6, the second index value (T3) of the vehicle outside temperature obtained when the determining section 301 of the controller 400 is activated while the main switch 120 is off is higher than the first index value (T1) of the vehicle outside temperature stored in the nonvolatile memory 102. The normal range used in the rationality check is shifted toward the high pressure side when it is assumed that the vehicle outside temperature at the performance of the rationality check is higher than the vehicle outside temperature when the main switch 120 is turned off. The fuel pressure is thus likely to remain in the normal range even if the vehicle outside temperature increases while the main switch 120 is off.

The present embodiment has the following advantages.

(1) The controller 400 shifts the normal range toward the high pressure side in accordance with changes in the vehicle outside temperature. This prevents an erroneous determination from being made due to an increase in the vehicle outside temperature, for example, despite the normally operating high-pressure-side fuel pressure sensor 132.

(2) The second index value (T3) of the vehicle outside temperature is obtained when the determining section 301 is activated by the soak timer 101. The first index value (T1) of the vehicle outside temperature stored in the nonvolatile memory 102. The determining section 301 of the controller 400 shifts the normal range toward the high pressure side to a greater extent as the difference between the second index value (T3) and the first index value (T1) increases when the second index value (T3) is higher than the first index value (T1). In other words, the greater the difference between the second index value and the first index value, the greater the shift amount by which the normal range NRb is shifted to NRx on the high pressure side becomes. The controller 400 is capable of changing the normal range by an amount corresponding to the deviation between the first index value of the vehicle outside temperature, which is stored in the nonvolatile memory 102, and the second index value of the vehicle outside temperature obtained by activating the determining section 301 while the main switch 120 is off.

An exemplary configuration is possible in which whether to correct the normal range is determined based on whether the second index value of the vehicle outside temperature obtained by activating the determining section 301 while the main switch 120 is off is deviated by a certain amount from the first index value of the vehicle outside temperature stored in the nonvolatile memory 102. Also, another configuration is possible in which a uniform correction is made if the first index value and the second index value are deviated from each other. As compared with such configurations, the present embodiment allows the normal range to be finely corrected.

(3) The rationality check of the present embodiment is performed when the elapsed amount of time measured by the soak timer 101 reaches the specified amount of time. The rationality check is performed on the assumption that the high-pressure-side fuel pressure has decreased to the vicinity of the reference pressure, which is the median of the normal range.

Therefore, in order to perform the rationality check, the fuel temperature needs to decrease a certain extent from a state of being relatively high. That is, in order to perform the rationality check, the reduction in the volume of the fuel stored in the high-pressure-side delivery pipe 71 due to the decrease in the temperature of the fuel stored in the high-pressure-side delivery pipe 71 needs to have progressed sufficiently to cause the high-pressure-side fuel pressure to decrease to the vicinity of the reference pressure.

In the controller 400, the performance condition for the rationality check is the logical conjunction of (i) the warm-up index value, which is correlated with the fuel temperature when the main switch 120 is turned off, being greater than or equal to the threshold, and (ii) the coolant temperature being lower than the specified temperature, the coolant temperature being correlated with the fuel temperature when the elapsed amount of time reaches the specified amount of time and having been obtained when the elapsed amount of time reaches the specified amount of time. That is, the controller 400 performs the rationality check on a condition that it is assumed that the fuel pressure has decreased a certain extent from a state of being relatively high, in addition to the condition that the elapsed amount of time has reached the specified amount of time. Thus, the controller 400 is capable of performing the rationality check after accurately confirming that the condition suitable for performance of the rationality check is met because the reduction in the volume of the fuel stored in the high-pressure-side delivery pipe 71 has progressed.

(4) The controller 400 has three specified amounts of time having different lengths, which are the first specified amount of time, the second specified amount of time, and the third specified amount of time. When the elapsed amount of time reaches each of the specified amounts of time, the soak timer 101 activates the controller 400, so that the activated determining section 301 determines whether the performance condition for the rationality check is met. If the performance condition is met, the determining section 301 performs the rationality check. If the performance condition is not met, the determining section 301 stops operating again without performing the rationality check. Until the rationality check is completed, determination as to whether the performance condition is met is repeated each time the elapsed amount of time reaches each of the specified amounts of time.

An exemplary configuration is possible in which only one specified amount of time is used, and the rationality check is not performed if the performance condition is not met when the elapsed amount of time reaches the specified amount of time. As compared with such a configuration, the present embodiment ensures opportunities for performance of the rationality check. That is, the controller 400 of the present embodiment is capable of performing the rationality check when the condition suitable for the rationality check is met and thus ensures the accuracy of the rationality check. In this manner, the present embodiment ensures opportunities for performance of the rationality check.

(5) The controller 400 performs the rationality check only once during the period in which the main switch 120 is off. An exemplary configuration is possible in which the rationality check is performed each time the elapsed amount of time reaches each of multiple specified amounts of time even after the rationality check is completed. As compared with such as configuration, the present embodiment allows the result of the rationality check to be quickly concluded.

The present embodiment may be modified as follows. The present embodiment and the following modifications can be combined as long as the combined modifications remain technically consistent with each other.

The specific method for shifting the normal range used in the rationality check toward the high pressure side is not limited to the correction process. For example, a calculation map may be employed that uses, as input, the magnitude of the difference obtained by subtracting the stored value from the obtained value, and simply outputs the values of the normal range. That is, the normal range may be determined based directly on the magnitude of the difference between the obtained value and the stored value.

Figure 7:
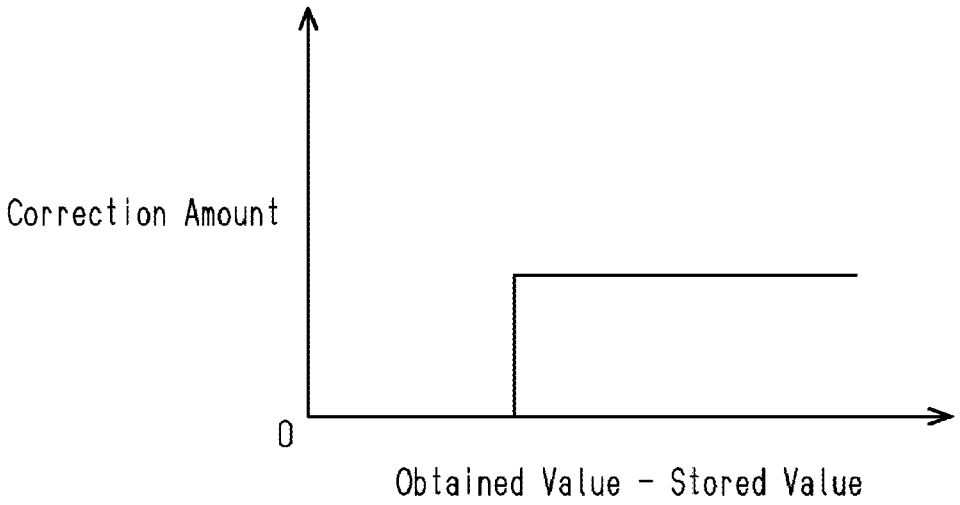
FIG. 7 is a graph showing the relationship between a correction amount in a correction process and a difference obtained by subtracting a stored value of the vehicle outside temperature from an obtained value of the vehicle outside temperature in a modification of the present disclosure.

Whether to correct the normal range may be determined by determining whether the deviation between the obtained value and the stored value is greater than or equal to a predetermined amount. If the deviation is greater than or equal to the predetermined amount, the normal range may be corrected toward the high pressure side by a uniform correction amount. When this configuration is employed, the correction amount is 0 when the difference between the obtained value and the stored value is less than the predetermined amount, so that the normal range is not corrected. In contrast, when the difference between the obtained value and the stored value is greater than or equal to the predetermined amount, the normal range is corrected by a uniform correction amount. Even with this configuration, erroneous determinations are limited as compared with a case in which, for example, the normal range is not shifted. Another modification may be made in which, unlike the configuration of FIG. 7, whether to correct the normal range is determined by determining whether the deviation between the obtained value and the stored value is greater than or equal to a predetermined amount. If the deviation is greater than or equal to the predetermined amount, the shift amount, by which the normal range is shifted toward the high pressure side, is increased as the amount by which obtained value is greater than the stored value increases.

In the above-described embodiment, an example is described in which the internal combustion engine 40 includes the high-pressure fuel supply system 70 and the low-pressure fuel supply system 50. However, the internal combustion engine 40 does not necessarily have to include two fuel supply systems. For example, the internal combustion engine in which the controller 400 is employed may include only a fuel supply system that corresponds to the high-pressure fuel supply system 70 without being equipped with the low-pressure-side delivery pipe 55 or the port injection valves 43. Typically, in a fuel supply system that corresponds to the low-pressure fuel supply system 50 but is not equipped with the high-pressure fuel pump 60, the rationality check can be performed by increasing the fuel pressure to the pressure at which the pressure regulator 56 is opened. That is, the rationality check can be performed based on whether the detected fuel pressure is within the normal range the center of which is a value closer to the upper limit.

However, if such a typical rationality check is performed in the high-pressure fuel supply system 70, which stores fuel having a pressure as high as several MPa, the fuel pressure needs to be increased by driving the high-pressure fuel pump 60 until the relief valve 66 is opened in order to perform the rationality check of the high-pressure-side fuel pressure sensor 132, which detects the fuel pressure in the high-pressure-side delivery pipe 71. Therefore, in the case of the high-pressure fuel supply system 70, it is not reasonable to perform the rationality check with reference to the pressure closer to the upper limit. That is, such a problem depends not on whether the fuel injection valves are the direct injection valves 44 or the port injection valves 43, but on whether the fuel pressure accumulated in the delivery pipe is high. Thus, when high pressure exceeding several MPa is accumulated in the delivery pipe, the fuel injection valves may be the port injection valves 43. Even in this case, it is not reasonable to perform the rationality check with reference to the pressure closer to the upper limit. Thus, the controller 400 preferably includes the determining section 301, which executes the correction process, as in the above-described embodiment.

The method for calculating the warm-up index value can be changed as appropriate. For example, the warm-up index value may increase as the accumulated operation time increases during the operation of the controller 400. Also, the warm-up index value may increase while the internal combustion engine 40 operates and decrease in correspondence with a length of time during which the internal combustion engine 40 is stopped. In this case, the extent of decrease per unit time of the warm-up index value may be increased as the vehicle outside temperature decreases. This configuration allows the warm-up index value to correspond to a situation in which as the vehicle outside temperature decreases, the extent of decrease in the temperature of the internal combustion engine 40 per unit time increases while the internal combustion engine 40 is in a stopped.

The above-described embodiment describes an example in which, once the rationality check is completed, the rationality check is not performed while the main switch 120 is off. The present disclosure is not limited to this. That is, the rationality check may be performed each time each of the specified amounts of time is reached. For example, the latest result of the rationality check may be used.

Although the result of the rationality check is concluded by the rationality check that is first performed, the rationality check may be performed thereafter each time the elapsed amount of time reaches each of specified amounts of time. However, this configuration consumes power since the controller 400 is activated wastefully, the determination of whether the performance condition for the rationality check is met is made, and the rationality check is actually performed. As compared with this configuration, the above-described embodiment reduces power consumption because it performs the rationality check only once while the period in which the main switch 120 is off is continuing.

The number of the specified amounts of time may be only one. That is, a configuration may be employed in which the rationality check is not performed if the performance condition is not met when the specified amount of time is reached.

The controller 400 is not limited to a controller that includes the system control unit 100, the power control unit 200, and the engine control unit 300. For example, the controller may be a physically one unit. Alternatively, the controller may be constituted by four or more units.

The method for calculating the estimated outside air temperature may be changed as appropriate. For example, the determining section 301 may calculate, as the estimated outside air temperature, the minimum value of the temperature of the intake air during the current trip. Also, the determining section 301 may calculate, as the estimated outside air temperature, the coolant temperature at the first starting of the internal combustion engine 40 during the current trip. Alternatively, the determining section 301 may calculate, as the estimated outside air temperature, the average value of the minimum value of the temperature of the intake air during the current trip and the coolant temperature at the first starting of the internal combustion engine 40 during the current trip.

The controller that shifts the normal range used in the rationality check as in the above-described embodiment may be employed in a plug-in hybrid vehicle, in which the battery 30 can be charged by an external power source. The controller that shifts the normal range as in the above-described embodiment may be employed in a vehicle that travels only by the force of the internal combustion engine 40.

In the above-described embodiment, the controller 400 includes various control units, or ECUs. The controller 400 can be constructed by devices that include, for example, a processor and a storing section including a ROM and execute software processing, but is not limited to this configuration. For example, at least part of the processes executed by the software in the above-described embodiments may be executed by hardware circuits dedicated to executing these processes (such as ASIC). That is, the controller and the respective control units may be modified as long as it has any one of the following configurations (a) to (c). (a) A configuration including a processor that executes all of the above-described processes according to programs and a program storage device such as a ROM (including a non-transitory computer readable memory medium) that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller for a vehicle, the controller being employed in a vehicle equipped with an internal combustion engine, wherein the vehicle includes a high-pressure fuel pump, a delivery pipe configured to store high-pressure fuel pressurized by the high-pressure fuel pump, a fuel injection valve configured to inject fuel stored in the delivery pipe, and a fuel pressure sensor configured to detect pressure of the fuel in the delivery pipe, the controller comprises:

a soak timer configured to measure an amount of time elapsed since a main switch of the vehicle was turned off;

a nonvolatile memory configured to retain information even when the main switch is turned off so that power supply is stopped; and a determining section configured to be activated when the elapsed amount of time reaches a specified amount of time while the main switch is off, the determining section is configured to obtain fuel pressure using the fuel pressure sensor when activated, perform a rationality check for determining whether the obtained fuel pressure is within a normal range, store a first index value of a vehicle outside temperature in the nonvolatile memory, and shift the normal range, which is used in the rationality check, toward a high pressure side when a second index value is higher than the first index value as compared with when the second index value is not higher than the first index value, the first index value is stored in the nonvolatile memory before the main switch is turned off so that the power supply is stopped, and the second index value is an index value of the vehicle outside temperature obtained when the elapsed amount of time reaches the specified amount of time so that the determining section is activated.

2. The controller for a vehicle according to claim 1, wherein the determining section is configured to increase a shift amount by which the normal range is shifted toward the high pressure side as a difference between the second index value and the first index value increases when the second index value is higher than the first index value, and the first index value is stored in the nonvolatile memory before the main switch is turned off so that operation of the determining section is stopped.

3. The controller for a vehicle according to claim 1, wherein the determining section is configured to obtain a coolant temperature of the internal combustion engine by being activated when the elapsed amount of time reaches the specified amount of time, the determining section is configured to perform the rationality check if a performance condition is met, the performance condition being a logical conjunction of (i) a warm-up index value being greater than or equal to a threshold, and (ii) the obtained coolant temperature being lower than a specified temperature, the warm-up index value is stored in the nonvolatile memory when the main switch is turned off so that operation of the determining section is stopped, the warm-up index value increases as an extent of warm-up of the internal combustion engine becomes higher, and the specified temperature is lower than a warm-up completion temperature.

4. The controller for a vehicle according to claim 3, wherein the specified amount of time is one of specified amounts of time having different lengths, the determining section is configured to be activated by the soak timer each time the elapsed amount of time reaches each of the specified amounts of time and to determine whether the performance condition is met when activated, the determining section is configured to perform the rationality check if the performance condition is met, and the controller is configured not to perform the rationality check and to stop the operation of the determining section if the performance condition is not met.

5. The controller for a vehicle according to claim 4, wherein the controller is configured not to activate the determining section while a state in which the main switch is off is continuing after the rationality check is completed once while a state in which the main switch is off is continuing, so that the rationality check is not performed.

6. A control method for a vehicle, the control method being employed in a vehicle equipped with an internal combustion engine, wherein the vehicle includes a high-pressure fuel pump, a delivery pipe that stores high-pressure fuel pressurized by the high-pressure fuel pump, a fuel injection valve that injects fuel stored in the delivery pipe, and a fuel pressure sensor that detects pressure of the fuel in the delivery pipe, the control method comprises:

measuring an amount of time elapsed since a main switch of the vehicle was turned off using a soak timer;

retaining information using a nonvolatile memory even when the main switch is turned off so that power supply is stopped;

activating a determining section when the elapsed amount of time reaches a specified amount of time while the main switch is off;

obtaining, by the activated determining section, fuel pressure using the fuel pressure sensor;

performing, by the determining section, a rationality check for determining whether the obtained fuel pressure is within a normal range;

storing, by the determining section, a first index value of a vehicle outside temperature in the nonvolatile memory before the main switch is turned off so that the power supply is stopped;

obtaining, by the determining section, a second index value of the vehicle outside temperature when the elapsed amount of time reaches the specified amount of time so that the determining section is activated; and shifting, by the determining section, the normal range, which is used in the rationality check, toward a high pressure side when the second index value is higher than the first index value as compared with when the second index value is not higher than the first index value.

7. A non-transitory computer readable memory medium that stores a program for causing a controller to execute a control process employed in a vehicle equipped with an internal combustion engine, wherein the vehicle includes a high-pressure fuel pump, a delivery pipe that stores high-pressure fuel pressurized by the high-pressure fuel pump, a fuel injection valve that injects fuel stored in the delivery pipe, and a fuel pressure sensor that detects pressure of the fuel in the delivery pipe, the control process includes measuring an amount of time elapsed since a main switch of the vehicle was turned off using a soak timer, retaining information using a nonvolatile memory even when the main switch is turned off so that power supply is stopped, activating a determining section when the elapsed amount of time reaches a specified amount of time while the main switch is off, obtaining, by the activated determining section, fuel pressure using the fuel pressure sensor, performing, by the determining section, a rationality check for determining whether the obtained fuel pressure is within a normal range, storing, by the determining section, a first index value of a vehicle outside temperature in the nonvolatile memory before the main switch is turned off so that the power supply is stopped, obtaining, by the determining section, a second index value of the vehicle outside temperature when the elapsed amount of time reaches the specified amount of time so that the determining section is activated, and shifting, by the determining section, the normal range, which is used in the rationality check, toward a high pressure side when the second index value is higher than the first index value as compared with when the second index value is not higher than the first index value.

* * * * *